US006221123B1

(12) United States Patent
Mann, Sr.

(10) Patent No.: US 6,221,123 B1
(45) Date of Patent: Apr. 24, 2001

(54) PROCESS AND APPARATUS FOR MELTING METAL

(75) Inventor: Arthur K. Mann, Sr., Lancaster, PA (US)

(73) Assignee: Donsco Incorporated, Wrightsville, PA (US)

( * ) Notice: Subject to any disclaimer, the term of this patent is extended or adjusted under 35 U.S.C. 154(b) by 0 days.

(21) Appl. No.: 09/010,633

(22) Filed: Jan. 22, 1998

(51) Int. Cl.[7] ..... C21B 13/12

(52) U.S. Cl. ..... 75/10.14; 75/10.15; 266/237; 373/4; 373/142

(58) Field of Search ..... 75/10.14, 10.15, 75/10.16, 10.17, 10.67, 10.66, 10.42; 266/237; 373/4, 142

(56) References Cited

U.S. PATENT DOCUMENTS

| | | | | |
|---|---|---|---|---|
| 1,713,543 | | 5/1929 | Machlet . | |
| 2,922,869 | | 1/1960 | Giannini et al. . | |
| 3,147,330 | | 9/1964 | Gage . | |
| 3,194,941 | | 7/1965 | Baird . | |
| 3,663,203 | | 5/1972 | Davis et al. . | |
| 3,673,375 | | 6/1972 | Camacho . | |
| 4,032,123 | | 6/1977 | Cruse, Jr. et al. . | |
| 4,033,562 | * | 7/1977 | Collin | 75/10.14 |
| 4,097,028 | | 6/1978 | Langhammer . | |
| 4,129,289 | | 12/1978 | Miyasita et al. . | |
| 4,309,170 | | 1/1982 | Ward . | |
| 4,311,519 | | 1/1982 | Berry . | |
| 4,685,657 | | 8/1987 | Okubo et al. . | |
| 4,786,321 | | 11/1988 | Hoster et al. . | |
| 4,877,449 | | 10/1989 | Khinkis . | |
| 5,224,985 | | 7/1993 | Kullik et al. . | |
| 5,407,462 | | 4/1995 | Areaux . | |
| 5,411,570 | * | 5/1995 | Fourie | 75/10.16 |
| 5,560,304 | | 10/1996 | Duchateau et al. . | |
| 5,563,904 | | 10/1996 | Colpo et al. . | |

* cited by examiner

*Primary Examiner*—Melvyn Andrews
(74) *Attorney, Agent, or Firm*—Caesar, Rivise, Bernstein, Cohen & Pokotilow, Ltd.

(57) ABSTRACT

An apparatus and a method for melting solid metals, including iron, are provided. The apparatus includes a vertical shaft furnace through which the metal is fed. The shaft furnace is mounted on a horizontal induction furnace containing a molten pool of metal. Metal solids are charged at the top of the vertical shaft furnace down onto a refractory pedestal in the molten metal pool or suspended magnetically in the vertical shaft above gas burners. The metal is melted by contact with the molten metal pool. The combination of oxygen fuel burner preheating and induction melting creates an extremely efficient melting unit that can process metal at a much lower cost than conventional systems while preventing the oxidation problems incurred by apparatuses which melt metal using combustion only. Because of the compact nature and the low stack velocity of the apparatus, almost all charged materials will convert into molten metal or slag, making the cleaning of the vertical shaft effluent to meet government air quality standards much easier than with conventional methods.

29 Claims, 4 Drawing Sheets

PROCESS AND APPARATUS FOR MELTING METAL

FIELD OF THE INVENTION

This invention relates to methods and devices for processing metals, and in particular, methods and devices for melting steel and/or iron objects efficiently.

BACKGROUND OF THE INVENTION

Conventional and commercially available melting systems include reverberatory, crucible, open hearth, cupola, electric induction, electric channel, electric arc, fuel assisted electric arc, conventional cupola, gas/oil fired vertical shaft furnaces with water-cooled grates and fuel-fired rotary drum furnaces. While all of these systems can and do operate to melt and superheat metal, there is room for improvement of each of these systems with respect to cost of installation, adaptability to a wide selection of fuels, cost of operation, cost of maintenance, flexibility of operation, equipment size, control of metallurgical properties, degree of potential pollution, installation cost of pollution controls and cost of operation of pollution controls.

Cupola melting units are efficient, low-cost melting devices especially in high ton-per-hour (over 50) units; however, they have a number of drawbacks. Using coke as the primary fuel, cupola operations are undesirably dependent on coke prices and availability. Because of the sulphur content of the coke, cupola melted irons can have excessive sulphur levels that are a problem in the production of ductile irons. Cupola off-gases are especially toxic and expensive to clean in order to meet governmental air quality standards for sulphur and particulate emissions. Cupolas are difficult to operate on an intermittent basis. When stopped, the delicate temperature equilibriums necessary for effective operation are destroyed and metallurgical control is made extremely difficult.

It is known to melt a charge in a vertical shaft furnace by feeding the charge into the top of the shaft furnace to form a column of charge in the furnace, and then melting the column from below with a flame. See, e.g., U.S. Pat. No. 5,224,985 to Kullik et al., U.S. Pat. No. 4,877,449 to Khinkis, U.S. Pat. No. 4,097,028 to Langhammer and U.S. Pat. No. 1,713,543 to Machlet.

U.S. Pat. No. 5,560,304 to Duchateau et al. discloses a furnace which employs a gas oxygen burner on a rotating barrel furnace; however this furnace is large and operates in a batch mode rather than continuously.

Vertical shaft furnaces with water-cooled grates operate successfully, but also have a number of drawbacks. The water-cooled pipes or grates have the potential for damage and leaking in such an environment. Water and water vapor are extremely detrimental to metallurgical properties of metal in the molten, superheated state of such a furnace. Further, the flame temperature and the metal temperature difference and therefore the efficiency of the system suffers as the operator attempts go above 2550° F. Metal in the molten condition at such temperatures is also highly susceptible to undesired oxidation. Metal is then guided into some form of electric furnace for superheating to temperatures required for treatment, pouring, processing or casting. This method is inefficient from an energy perspective and further exposes the molten metal to oxidizing conditions. Silicon losses can go as high as 1% of the charge weight, a loss that can be very expensive as the lost silicon must be replaced. Oxidized irons also exhibit inferior metallurgical properties.

Electric melting, whether it be induction, induction channel or arc, is an efficient and effective way to process metal. Recovery of ingredients and additives is nearly 100%, as there is little oxidation since the metal charges are preheated primarily for removing water and for a small assist in melting efficiency. Arc furnaces can be fitted with fuel burners to assist in the melting down of the charge and are highly efficient melters. However, installation of dust collectors, which is required for electric furnaces, is a major expense. Further, installation of a large electric furnace is very costly. In terms of overall efficiency from a macroeconomic perspective, electric furnaces are not necessarily very efficient, since only 22% of the coal burned in a power plant is typically converted to electric power, which can then be used to power an electric furnace. The remainder is wasted heat and excessive production of $CO_2$ gases.

Thus, there has been a need for more efficient furnaces for melting metals, which are less costly to install and maintain.

All references cited herein are incorporated herein by reference in their entireties.

SUMMARY OF THE INVENTION

The invention addresses the foregoing deficiencies of the prior art by providing a method for melting a metal, the method comprising:

providing an apparatus comprising:

a vertical shaft furnace having a top portion, an intermediate portion, a bottom portion and at least one shaft furnace heating device preferably selected from the group consisting of a gas burner and electric arc generator; and a horizontal induction furnace in fluid communication with, and at least partially below, said shaft furnace;

feeding said metal into said top portion of said shaft furnace to form a column of said metal within said shaft furnace;

preheating metal in a bottom of said metal column with said at least one shaft furnace heating device to a temperature below a melting temperature of said metal;

contacting said preheated metal with a molten pool of metal in said induction furnace to melt said metal; and removing from said apparatus at least a portion of said molten pool of metal.

The invention also provides an apparatus for melting a metal by the foregoing method, and an exhaust fumes treatment apparatus for treating the fumes generated in the method.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

The apparatus of the present invention is essentially a fuel fired vertical shaft furnace married to a horizontal electric induction furnace, whereby the efficiencies of each are maximized in the melting of metal without adversely affecting the metallurgical properties of the charged material.

Melting is accomplished using electrical energy. The preheated melted column sits in a shallow bath of molten metal supported on a pedestal or suspended magnetically in the shaft. At that point, almost eighty percent (80%) of the energy required for the melting process is in the charge. Therefore, the relatively more expensive electrical energy is preferably used where it is most effective and where fuel systems are least effective. This combination allows the apparatus of the invention to operate at less than half of the cost of electric melt systems and substantially less than other systems. Because of its relatively small size, it is less expensive and easier to install than other systems. By using a short stack design, the invention can be easily shut down if metal is not needed without affecting metallurgical properties or process efficiency.

Dusts or additives can be easily injected into the melted metal using the apparatus of the invention. Carbon, in the form of coke or coal, can be added in the stack for carbon pickup by the charged metal or to assist in controlling oxidizing conditions.

By providing the induction furnace on its side, there is a highly efficient transfer of the electrical energy into the metal. Furthermore, keeping the induction furnace constantly filled with molten metal prevents the furnace refractory from being exposed to air and therefore enables the induction furnace of the inventive apparatus to operate up to a year without having to be relined as often as conventional induction furnaces.

The combustion system can use special combinations of fuel and oxygen to create a reducing atmosphere and stratified temperature gradient that allows high temperature preheating without oxidation of silicon and reduced oxidation of iron during processing.

Figure 1:
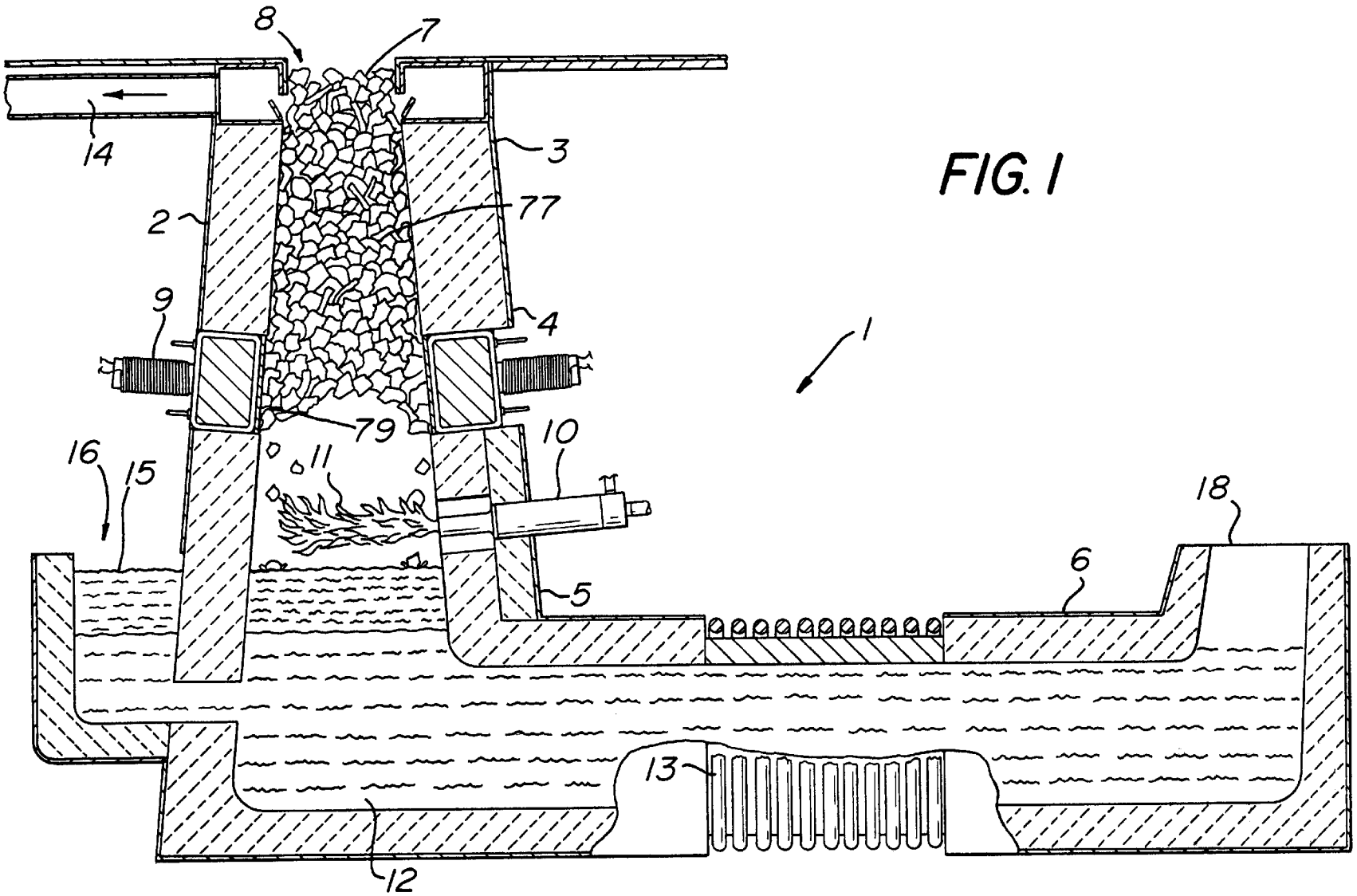
FIG. 1 is a partial cross-sectional view of an embodiment of a melting apparatus according to the invention.
Figure 2:
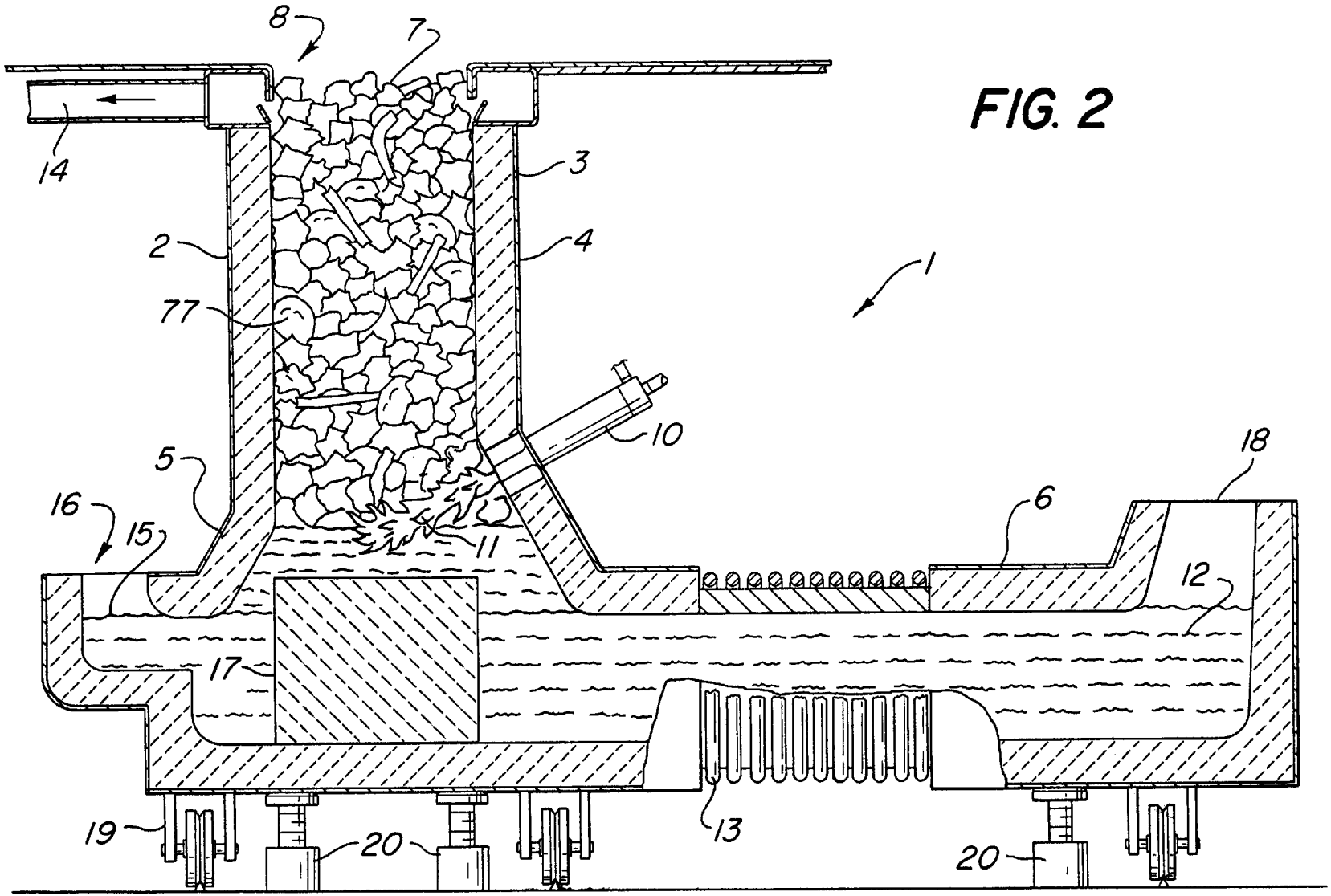
FIG. 2 is a partial cross-sectional view of another embodiment of a melting apparatus according to the invention.
Figure 3:
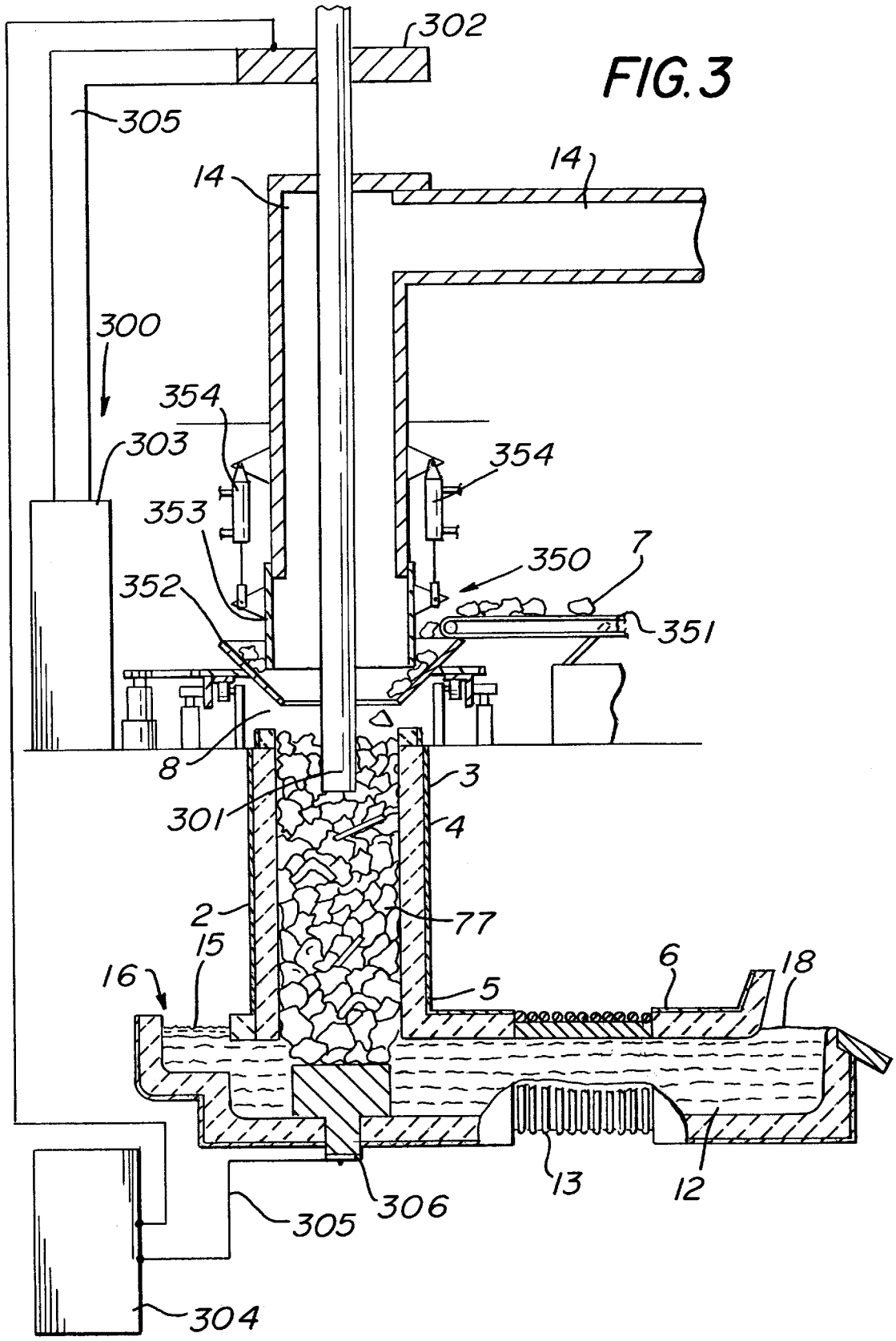
FIG. 3 is a partial cross-sectional view of another embodiment of a melting apparatus according to the invention.

As shown in FIGS. 1–3, preferred embodiments of an apparatus 1 for performing the method of the invention comprise a vertical shaft furnace 2 having a top portion 3, an intermediate portion 4 and a bottom portion 5. Bottom portion 5 adjoins, and is in fluid communication with, a horizontal induction furnace 6. Induction furnace 6 is at least partially below shaft furnace 2, and extends horizontally away from an axis defined by shaft furnace 2.

In the embodiment of FIG. 1, shaft furnace 2 tapers inwardly from bottom portion 5 to top portion 3 at a taper angle of about 5°. In the embodiment of FIG. 2, shaft furnace 2 flares outwardly below the intermediate portion 4, in trumpet-like fashion. Shaft furnace 2 can be constructed of any material known to be durable when subjected to the temperatures employed in the method of the invention discussed below, such as, e.g., aluminum oxide, magnesium oxide and refractory carbons.

Shaft furnace 2 is substantially vertical and induction furnace 6 is substantially horizontal. For present purposes, "vertical" means that the central axis of the shaft furnace is within ±10° of being perfectly plumb, and "horizontal" means that the central axis of the induction furnace is within ±10° of being perfectly parallel to the ground.

In embodiments of the method of the invention, a metal 7 is fed through an inlet 8 in the top portion of shaft furnace 2. The apparatus and method are particularly suited for melting ferrous objects, more particularly, steel and iron objects.

Metal 7 passes downward through shaft furnace 2, filling the internal cavity of shaft furnace 2 to form metal column 77, until metal 7 encounters resistance sufficient to oppose the force of gravity pulling metal 7 downward.

In the embodiment depicted in FIG. 1, resistance is provided by water-cooled magnets 9 embedded within intermediate portion 4 of the shaft furnace 2. Magnets 9 are separated from metal 7 by water-cooled plates 79. Magnets 9 attract and prevent metal 7 from falling unimpeded into induction furnace 6. The metal column 77 formed above magnets 9 is heated from below by at least one burner 10. Burner 10 preferably burns an oil or gas and oxygen mixture, and is located sufficiently below the column of metal 7 to avoid contacting the column of metal 7 with flame 11. This arrangement allows for uniform heating of the charge without direct flame impingement.

Instead of burner 10, a plasma arc generator 300 can be used to heat metal 7, as shown in FIG. 3. Plasma arc generators are described, e.g., in U.S. Pat. Nos. 4,309,170; 3,673,375; 3,194,941; 3,147,330; and 2,922,869.

In the embodiment of FIG. 1, metal 7 at the bottommost portion of metal column 77 is heated by burner 10 sufficiently to lose enough of its magnetic properties to fall further down shaft furnace 2 past burner 10 and into a pool 12 of molten metal 7 in induction furnace 6. It is preferred to heat metal at the bottommost portion of metal column 77 to a temperature below its melting point. This helps to prevent undue oxidation of metal 7. In the case of iron, it is preferred to heat the metal column bottom to about 1500° F., at which temperature pieces of iron drop from the column bottom and fall into pool 12. In general, it is preferred to heat the bottom of metal column 77 to a temperature within about 100° F. of the melting temperature of said metal.

It is preferred to maintain pool 12 at a temperature approximately at or just above the melting point of metal 7. Raising the temperature of pool 12 significantly above the melting point of metal 7 serves no useful purpose and is an energy drain on the system. In the case of iron, it is preferred to heat pool 12 to a temperature of about 2750° F. Pool 12 is heated with coreless induction coils 13, or the like, which are preferably water-cooled.

In addition to heating the bottommost portion of the metal column, heat and combustion gases rise through the shaft furnace, preheating distal portions of the metal column. The preferred temperature of the gas as it leaves the shaft furnace through outlet 14 is about 1600° F. A temperature probe (not shown) can be used to monitor this exhaust temperature.

By using at least one oxygen burner 10 designed to process any type of fuel including methanes, oils and carbons, the vertical shaft furnace 2 operates with a reducing atmosphere and a high flame temperature at the bottom of the shaft. As the gases rise through the charge burden (i.e., metal column 77), preheated air or more oxygen can be injected into the stream to complete combustion of the gases higher in shaft furnace 2, thereby recovering the heat potential without oxidizing the metal. Heat can be recaptured by an air-to-air preheater in outlet 14 and reinjected into the upper regions of shaft furnace 2 to complete combustion of the reducing gas where, with the lower temperatures of the metal charge, the resulting oxidizing atmosphere will not attack metal 7 in the charge.

The heating method controls the rate of metal oxidation and the condition of elements, such as silicon and manganese, present in the metal matrix. By careful selection of fuels, conditions within shaft furnace 2 can be created whereby elements can be reduced from their oxides (e.g., sand, $SiO_2$, can be reduced to silicon) . Alternative fuels and additives may be injected into the lower combustion area of shaft furnace 2 to regulate and control the metallurgical properties of the melted metal 7.

By primarily using oxygen in the lower part of shaft furnace 2 rather than air, no nitrous oxides will be formed in this process. Furthermore, shaft gas volumes are only 20% of what they would be with air combustion units. The resulting low shaft gas velocity allows small particles to be charged without being blown back out of the shaft.

Slag 15 generated by the process can be separated from the molten pool of metal 7 through a slag outlet 16 at the base of shaft furnace 2. Most of the dust and dirt is converted to slag 15, removed from slag outlet 16 and can be sold for use in construction of roads or in making concrete. The apparatus 1 can be designed to have an almost pure $CO_2$ output, which allows for inexpensive conversion of the gas stream to marketable byproducts, such as limestone or baking soda, as discussed in further detail below.

FIG. 2 depicts an embodiment in which most of metal column 77 is supported above pool 12 by pedestal 17, which is supported by induction furnace 6 and submerged in pool 12, at least intermittently. The bottommost portion of metal column 77 is submerged in pool 12 and slag 15, which melts the bottommost portion of metal column 77. As the bottommost portion of metal column 77 melts, metal 7 in metal column 77 advances downward continuously. The depth of the molten metal covering the bottommost portion of metal column 77 is varied according to the melt rate and whether more energy is desired from the fuel or electric systems. Preferably, about 2 to about 12 inches of molten metal cover the bottommost portion of metal column 77.

In the present context, the term "continuously" as used in expressions such as "advances downward continuously" is not intended to denote an infinitely long occurrence of the activity being described, but rather is intended to denote that the activity occurs without pause to reload the apparatus between charges. That is, the term "continuously" is used in its broadest sense to distinguish the continuously operative mode of the invention from the batch mode of certain prior art. The term does not preclude periods of inactivity, as long as they are not caused by the need to recharge the apparatus with another batch of metal.

Pedestal 17 must be resistant to metal 7, pool 12 and the temperatures employed in the methods of the invention. It is preferred that pedestal 17 comprise carbon or a refractory material, such as alumina.

A pedestal 17 can also be used in the embodiment depicted in FIG. 1 to minimize splashing if metal column 77 inadvertently falls into molten metal pool 12.

In the embodiment of FIG. 2, gas burner 10 is directed at a side of metal column 77 just above pedestal 17 to preheat metal 7 before it enters pool 12 and melts. Preferably, a plurality of gas burners 10 are set with a downward slope to assist penetration of flame 11 into metal column 77.

Molten metal 7 in pool 12 is drawn off from induction furnace 6 through a metal outlet 18, so as to maintain pool 12 at a relatively constant level as metal 7 falls into pool 12 and melts therein. While the apparatus of the invention is preferably employed in a continuous melt process, a vacuum column (not shown) can be attached to the apparatus to store melted metal until the time for transfer.

The apparatus 1 can be mounted on wheel assemblies 19 and/or jacks 20.

As mentioned above, FIG. 3 shows an embodiment in which an arc generator 300 is used to heat metal 7. Generator 300 comprises an electrode rod 301 partially submerged within metal column 77. Electrode rod 301 is supported by an electrode holder 302, which is attached to a hydraulic lift mechanism 303. Hydraulic lift mechanism 303 enables movement of electrode rod 301 relative to metal column 77. Electrode rod 301 is in electrical communication with an electrical source 304 through an electrically conductive wire 305. Another electrically conductive wire 305 places electrical source 304 in electrical communication with electrode pedestal 306. An arc (not shown) is formed between electrode rod 301 and electrode pedestal 306.

FIG. 3 also depicts a carousel feeding assembly 350, which is a preferred means for feeding metal 7 into shaft furnace 2, and is suitable for use with, e.g., the embodiments of the invention depicted in FIGS. 1 and 2 as well as in FIG. 3. Carousel feeding assembly 350 comprises a conveyor belt assembly 351, which feeds metal 7 onto rotating funnel 352. Funnel 352 is rotated to facilitate the movement of metal 7 into inlet 8 at the top portion of shaft furnace 2. A ring 353 is provided above funnel 352 to help control the flow of metal 7 into shaft furnace 2. Ring 353 is raised to increase the flow of metal 7 or lowered to decrease the flow of metal 7 by air cylinders 354 attached to ring 353 and to the external walls of exhaust outlet 14. The air cylinders 354 are controlled by a charge height sensor 355 (see FIG. 4) at the top of shaft furnace 2.

Figure 4:
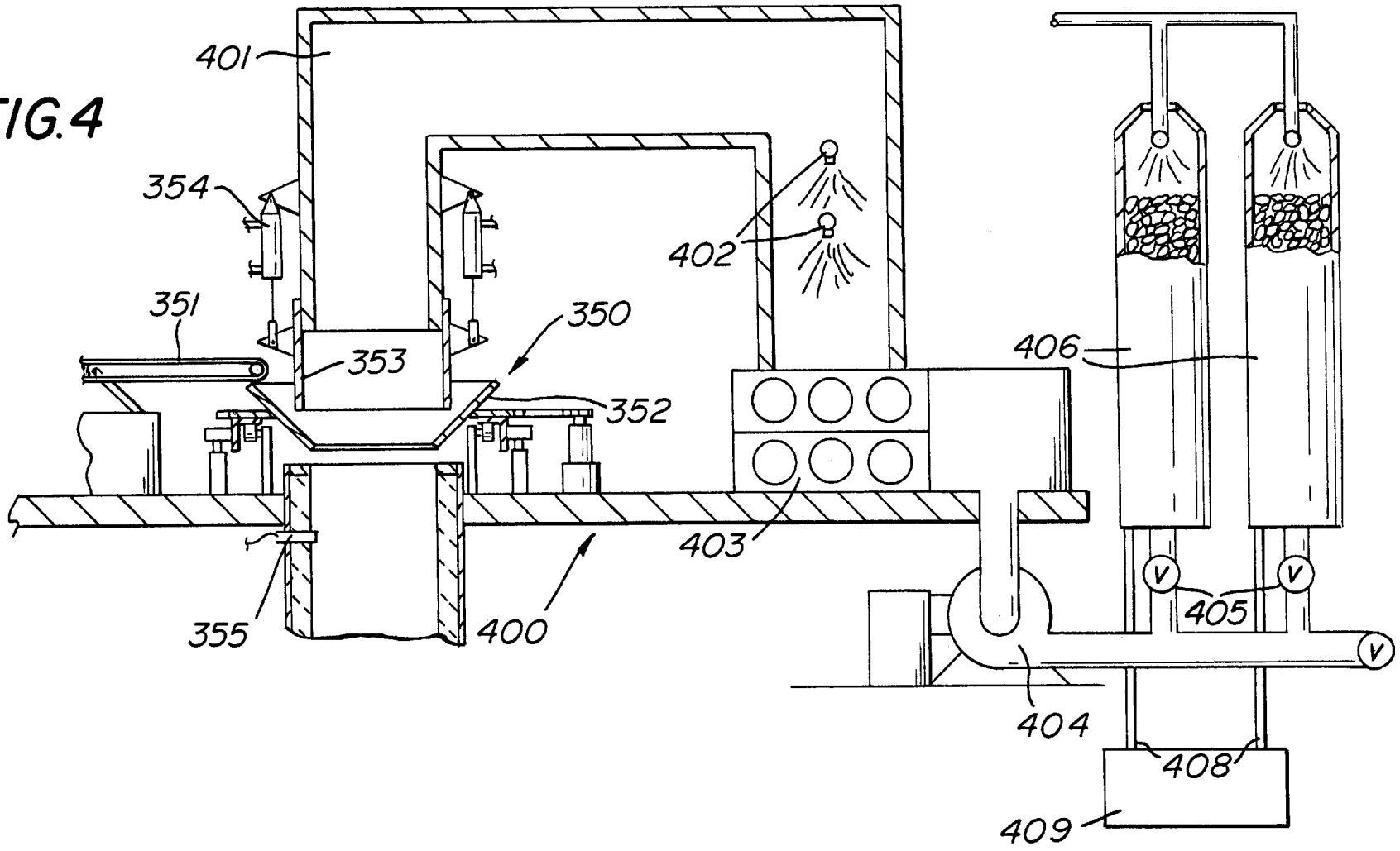
FIG. 4 is a cross-sectional view of an exhaust gas recycling system according to the invention.

FIG. 4 depicts an exhaust recovery system 400, which is a preferred means for recycling the exhaust fumes generated in melting metals. The fumes flow through exhaust fumes duct 401 and are cooled by water showers 402 in duct 401. The fumes then flow through a cooling/filtration device 403 to a fan 404, which forces the cooled and filtered fumes through valves 405 into at least one tower 406 (the preferred embodiment of two towers 406 is shown in FIG. 4). The fumes, which largely consist of carbon dioxide, are sprayed with a reactive fluid from tower showers 407. The reactive fluid comprises water and at least one reactive agent which reacts with carbon dioxide in the presence of water to form a useful solid compound. Sodium hydroxide, which reacts with carbon dioxide to form sodium bicarbonate, and calcium oxide, which reacts with carbon dioxide to form calcium carbonate, are preferred reactive agents. Water and the product of the reaction in towers 406 are transferred from towers 406 through effluent tubes 408 into a filter press system 409, from which the solid product of the reaction is separated from water and recovered for use.

The exhaust fumes treatment system described above can also be used with melting devices other than the melting device of the invention, and can be adapted for use with any device which generates carbon dioxide-containing fumes or other reactive fumes.

While the invention has been described in detail and with reference to specific examples thereof, it will be apparent to one skilled in the art that various changes and modifications can be made therein without departing from the spirit and scope thereof.

What is claimed is:

1. A method for melting a metal, said method comprising:

providing an apparatus comprising:

a vertical shaft furnace having a top portion, an intermediate portion, a bottom portion and at least one shaft furnace heating device selected from the group consisting of a gas burner and electric arc generator; and a horizontal induction furnace in fluid communication with, and at least partially below, said shaft furnace;

feeding said metal into said top portion of said shaft furnace to form a column of said metal within said shaft furnace;

preheating metal in a bottom of said metal column with said at least one shaft furnace heating device to a temperature below a melting temperature of said metal, wherein said at least one shaft furnace heating device is at least one burner, and wherein said metal column is suspended above said at least one gas burner by a magnetic field provided under said bottom of said metal column, and said metal in a bottommost portion of said metal column bottom is heated sufficiently to lose enough of its magnetic properties to separate from said metal column and pass through said magnetic field, thereby advancing said metal in said column downward toward said induction furnace;

contacting said preheated metal with a molten pool of metal in said induction furnace to melt said metal; and removing from said apparatus at least a portion of said molten pool of metal.

2. The method of claim 1, wherein said metal is ferrous.

3. The method of claim 2, wherein said metal is iron.

4. The method of claim 3, wherein said bottommost portion of said metal column is heated to a temperature of about 1500° F.

5. The method of claim 4, wherein said pool is maintained at a temperature of about 2750° F.

6. The method of claim 1, wherein said at least one gas burner burns a gaseous mixture comprising oxygen.

7. A method for melting a metal, said method comprising:

providing an apparatus comprising:

a vertical shaft furnace having a top portion, an intermediate portion, a bottom portion and at least one shaft furnace heating device selected from the group consisting of a gas burner and electric arc generator; and a horizontal in induction furnace in fluid communication with, and at least partially below, said shaft furnace;

feeding said metal into said top portion of said shaft furnace to form a column of said metal within said shaft furnace, wherein said metal column rests on a substrate submerged in said molten pool of metal, and wherein said substrate is a carbon or refractory pedestal supported by said induction on furnace;

preheating metal in a bottom of said metal column with said at least one shaft furnace heating device to a temperature below a melting temperature of said metal;

contacting said preheated metal with a molten pool of metal in said induction furnace to melt said metal; and removing from said apparatus at least a portion of said molten pool of metal, wherein a first electrode is placed in contact with said metal column, said pedestal is a second electrode, and an electric arc is provided between said first and second electrodes to preheat said metal column.

8. The method of claim 7, wherein said at least one gas burner adjacent to a side of said metal column preheats said metal column bottom and only a bottommost portion of said metal column bottom is submerged in said molten pool of metal.

9. The method of claim 8, wherein said molten pool of metal is heated by induction coils in said induction furnace.

10. The method of claim 7, wherein said molten pool of metal is heated by induction coils in said induction furnace.

11. A method for melting a metal, said method comprising:

providing an apparatus comprising:

a vertical shaft furnace having a top portion, an intermediate portion, a bottom portion and at least one shaft furnace heating device selected from the group consisting of a gas burner and electric arc generator; and a horizontal induction furnace in fluid communication with, and at least partially below, said shaft furnace;

feeding said metal into said top portion of said shaft furnace to form a column of said metal within said shaft furnace, wherein said metal is fed into said top portion of said shaft furnace by a carousel feeder comprising a rotating funnel provided above said shaft furnace;

preheating metal in a bottom of said metal column with said at least one shaft furnace heating device to a temperature below a melting temperature of said metal;

contacting said preheated metal with a molten pool of metal in said induction furnace to melt said metal; and removing from said apparatus at least a portion of said molten pool of metal.

12. A method for melting a metal, said method comprising:

providing an apparatus comprising:

a vertical shaft furnace having a top portion, an intermediate portion, a bottom portion and at least one shaft furnace heating device selected from the group consisting of a gas burner and electric arc generator; and a horizontal induction furnace in fluid communication with, and at least partially below, said shaft furnace;

feeding said metal into said top portion of said shaft furnace to form a column of said metal within said shaft furnace;

preheating metal in a bottom of said metal column with said at least one shaft furnace heating device to a temperature below a melting temperature of said metal;

contacting said preheated metal with a molten pool of metal in said induction furnace to melt said metal; and removing from said apparatus at least a portion of said molten pool of metal, wherein exhaust fumes generated by heating said metal are permitted to rise through said shaft furnace, cooled, conveyed into at least one reaction tower, and sprayed with at least one reactive agent and water to form a solid byproduct, and said solid byproduct is collected from said reaction tower.

13. The method of claim 12, wherein said exhaust fumes comprise $CO_2$, said reactive agent is NaOH and said solid byproduct is $NaHCO_3$.

14. The method of claim 12, wherein said exhaust fumes comprise $CO_2$, said reactive agent is CaO and said solid byproduct is $CaCO_3$.

15. An apparatus for performing the method of melting a metal according to claim 1, said apparatus comprising:

said vertical shaft furnace;

said horizontal induction furnace in fluid communication with, and at least partially below, said shaft furnace;

said gas burner for heating said metal column, located in said bottom portion of said shaft furnace below said metal column;

a water-cooled magnet for magnetically suspending said metal column above said gas burner, located on said intermediate portion of said shaft furnace;

a slag outlet in said induction furnace for separating slag from the molten pool of metal; and induction coils in said induction furnace for heating the molten metal pool.

16. The apparatus of claim 15, wherein said water-cooled magnet is separated from said metal column by a water-cooled plate.

17. The apparatus of claim 15, wherein said induction coils are water-cooled and coreless.

18. The apparatus of claim 15, wherein a carbon or refractory pedestal is mounted in said induction furnace at a position below said metal column, said pedestal being adapted to minimize splashing if said metal column falls into said molten metal pool.

19. The apparatus of claim 15, wherein said shaft furnace tapers from bottom portion to top portion at a taper angle of about 5°.

20. The apparatus of claim 15, wherein said top portion includes an inlet for receiving said metal and wherein a carousel feeder feeds said metal through said inlet, said carousel feeder comprising a rotatable funnel on which said metal is temporarily deposited until it is fed through said inlet.

21. An apparatus for performing the method of melting a metal according to claim 12, said apparatus comprising:

said vertical shaft furnace;

said horizontal induction furnace in fluid communication with, and at least partially below, said shaft furnace;

said gas burner for heating said metal column within said shaft furnace, said gas burner being located in said bottom portion of said shaft furnace below said metal column;

a water-cooled magnet for magnetically suspending said metal column above said gas burner, said magnet being located on said intermediate portion of said shaft furnace;

a slag outlet in said induction furnace for separating slag from the molten pool of metal;

induction coils in said induction furnace for heating the molten metal pool;

an outlet for expelling exhaust fumes from said shaft furnace;

an exhaust fumes duct in fluid communication with said exhaust fumes outlet;

an exhaust fumes cooling device in fluid communication with said exhaust fumes duct;

an exhaust fumes filter in fluid communication with said exhaust fumes cooling device;

said at least one reaction tower in fluid communication with said exhaust fumes filter, said at least one tower comprising an exhaust fumes inlet, a nozzle at a top end of said at least one tower for spraying water and a reactive agent over said exhaust fumes which enter said at least one tower, and a byproduct outlet for expelling an effluent comprising water and solid material from said at least one tower; and a filter press device for receiving said effluent and for separating said water from said solid material in said effluent.

22. An apparatus for performing the method of melting a metal according to claim 9, said apparatus comprising:

said vertical shaft furnace, wherein said shaft furnace flares outwardly in said bottom portion in a downward direction;

said horizontal in induction furnace in fluid communication with, and at least partially below, said shaft furnace;

said gas burner for heating said metal column in said shaft furnace, said gas burner being located in said bottom portion of said shaft furnace adjacent to said metal column;

said carbon or refractory pedestal supported by said induction furnace, and on which said metal column rests;

a slag outlet in said induction furnace for separating slag from the molten pool of metal; and said induction coils in said induction furnace for heating the molten metal pool.

23. The apparatus of claim 22, wherein said induction coils are water-cooled and coreless.

24. The apparatus of claim 22, wherein said pedestal is positioned so that all of said metal column is above said molten metal pool except for a bottommost about 2 to about 12 inches thereof.

25. The apparatus of claim 22, wherein said top portion includes an inlet for receiving said metal and wherein a carousel feeder feeds said metal through said inlet, said carousel feeder comprising a rotatable funnel on which said metal is temporarily deposited until it is fed through said inlet.

26. An apparatus for performing the method of melting a metal according to claim 12, said apparatus comprising:

said vertical shaft furnace, wherein said shaft furnace flares outwardly in said bottom portion in a downward direction;

said horizontal induction furnace in fluid communication with, and at least partially below, said shaft furnace;

said gas burner for heating said metal column, located in said bottom portion of said shaft furnace adjacent to said metal column;

a carbon or refractory pedestal supported by said induction furnace, and on which said metal column rests;

a slag outlet in said induction furnace for separating slag from the molten pool of metal;

induction coils in said induction furnace for heating the molten metal pool;

an outlet for expelling exhaust fumes from said shaft furnace;

an exhaust fumes duct in fluid communication with said exhaust fumes outlet;

an exhaust fumes cooling device in fluid communication with said exhaust fumes duct;

an exhaust fumes filter in fluid communication with said exhaust fumes cooling device;

said at least one tower in fluid communication with said exhaust fumes filter, said at least one tower comprising an exhaust fumes inlet, a nozzle at a top end of said at least one tower for spraying water and a reactive agent over said exhaust fumes which enter said at least one tower, and a byproduct outlet for expelling an effluent comprising water and solid material from said at least one tower; and a filter press device for receiving said effluent and for separating said water from said solid material in said effluent.

27. An apparatus for performing the method of melting a metal according to claim 10, said apparatus comprising:

said vertical shaft furnace;

said horizontal induction furnace in fluid communication with, and at least partially below, said shaft furnace;

said refractory pedestal supported by said induction furnace and on which said metal column rests, said pedestal being electrically conductive;

a first electrode insertable within said shaft furnace;

an electric current source in electrical communication with said first electrode and said pedestal;

a slag outlet in said induction furnace for separating slag from the molten pool of metal; and said induction coils in said induction furnace for heating the molten metal pool.

28. The apparatus of claim 27, wherein said top portion includes an inlet for receiving said metal and wherein a carousel feeder feeds said metal through said inlet, said carousel feeder comprising a rotatable funnel on which said metal is temporarily deposited until it is fed through said inlet.

29. An apparatus for performing the method of melting a metal according to claim 12, said apparatus comprising:

said vertical shaft furnace;

said horizontal induction furnace in fluid communication with, and at least partially below, said shaft furnace;

a refractory pedestal supported by said induction furnace and on which said metal column rests, said pedestal being electrically conductive;

a first electrode insertable within said shaft furnace;

an electric current source in electrical communication with said first electrode and said pedestal;

a slag outlet in said induction furnace for separating slag from the molten pool of metal;

induction coils in said induction furnace for heating the molten metal pool;

an outlet for expelling exhaust fumes from said shaft furnace;

an exhaust fumes duct in fluid communication with said exhaust fumes outlet;

an exhaust fumes cooling device in fluid communication with said exhaust fumes duct;

an exhaust fumes filter in fluid communication with said exhaust fumes cooling device;

said at least one tower in fluid communication with said exhaust fumes filter, said at least one tower comprising an exhaust fumes inlet, a nozzle at a top end of said at least one tower for spraying water and a reactive agent over said exhaust fumes which enter said at least one tower, and a byproduct outlet for expelling an effluent comprising water and solid material from said at least one tower; and a filter press device for receiving said effluent and for separating said water from said solid material in said effluent.

* * * * *